United States Patent [19]

Hanyu et al.

[11] Patent Number: 4,583,475

[45] Date of Patent: Apr. 22, 1986

[54] PRESSER FOOT FOR ZIGZAG SEWING MACHINES

[75] Inventors: Susumu Hanyu, Hachioji; Akio Koide, Kokubunji, both of Japan

[73] Assignee: Janome Sewing Machine Industry Co., Ltd., Japan

[21] Appl. No.: 550,696

[22] Filed: Nov. 10, 1983

[30] Foreign Application Priority Data

Nov. 16, 1982 [JP] Japan ..... 57-172326[U]

[51] Int. Cl.[4] ..... D05B 29/00; D05B 3/02

[52] U.S. Cl. ..... 112/235; 112/446

[58] Field of Search ..... 112/158 R, 235, 150, 112/151, 266.1, 158 B

[56] References Cited

U.S. PATENT DOCUMENTS

| | | | |
|---|---|---|---|
| 478,095 | 7/1892 | Douglas | 112/235 |
| 506,455 | 10/1893 | Woodward | 112/235 |
| 907,485 | 12/1908 | Fellows | 112/235 X |
| 990,614 | 4/1911 | Weis | 112/235 |
| 2,706,460 | 4/1955 | Grossman | 112/235 |
| 2,814,266 | 11/1957 | Marshall | 112/235 |
| 3,374,759 | 3/1968 | Longeone | 112/151 X |
| 3,512,490 | 5/1970 | Wener | 112/151 X |
| 3,817,195 | 6/1974 | Meier | 112/235 |
| 4,372,233 | 2/1983 | Odermann | 112/235 |

OTHER PUBLICATIONS

Superior Sewing Machine & Supply Corp. master catalog 1969, pp. 33, 34, 39, 42, 54.

*Primary Examiner*—Werner H. Schroeder
*Assistant Examiner*—Andrew M. Falik
*Attorney, Agent, or Firm*—William A. Drucker

[57] ABSTRACT

A presser foot used in combination with a zigzag sewing machine, which is especially adapted to produce a combination stitch comprising a first half series of stitches and a second half series of stitches formed in the normal feeding direction. The presser foot is provided on the bottom at one side thereof with a recess in the feeding direction for preventing the precedingly formed first half series of stitches from contacting the bottom of the presser foot while the second half series of stitches are being formed.

2 Claims, 7 Drawing Figures

PRESSER FOOT FOR ZIGZAG SEWING MACHINES

BACKGROUND OF THE INVENTION

The invention relates to a presser foot for use in combination with a sewing machine, and more particularly, to a presser foot used in combination with a zigzag sewing machine which is especially adapted to produce a combination stitch.

The term "combination stitch" as used herein means a pattern of stitches as shown in FIG. 1 by the reference numeral 1 by way of example, which is produced in such manner that a first series of stitches 2 are firstly formed on a fabric in the normal feeding direction A' as shown in FIG. 2 and then the fabric is turned 180-degree to bring the bottom to the top, and a second series of stitches 3 are formed again in the normal feeding direction as shown in FIG. 1. In this case, during formation of the second series of stitches 3, the bottom surface of a presser foot of a sewing machine is partly pressed against the precedingly formed first series of stitches 2 and is subject to a considerable frictional resistance. As the result, the feeding amount $P_2$ of the second series of stitches 3 may be decreased and get shorter as compared with the feeding amount $P_1$ of the first series of stitches 2, as shown in FIG. 3. Consequently, the finished pattern of stitches 1 would become remarkably deformed, especially when the intended combination stitch 1 comprises a pair of symmetric stitch patterns.

SUMMARY OF THE INVENTION

It is therefore an object of the invention to provide a novel presser foot for sewing machine, capable of eliminating such defects and disadvantages unavoidable in forming a combination stich by means of the prior art presser foot.

Another object of the invention is to provide a presser foot which is capable of producing a combination stitch of a balanced proportion.

Still another object of the invention is to provide a presser foot made of a transparent material so as to improve sewing efficiency.

According to an aspect of the invention there is provided a presser foot to be used in combination with a zigzag sewing machine for producing a combination stitch, comprising a needle dropping hole adapted to allow lateral swinging movement of a reciprocating needle and a recess provided on the bottom face at one side thereof, said recess being defined by a face positioned higher than the bottom face of the presser foot with a predetermined vertical distance therebetween and by a side wall connecting the inner end of the upper face and the bottom face of the presser foot and extending transversely of one of the needle dropping points of the laterally swinging needle within the needle dropping hole.

BRIEF DESCRIPTION OF DRAWINGS

The foregoing and other objects as well as the characteristic features of the present invention will be more easily understood by the following description and appended claims when read in conjunction with the accompanying drawings wherein:

FIG. 2 is an explanatory view of a first half series of stitches of the combination stitch shown in FIG. 1;

PREFERRED EMBODIMENT OF THE INVENTION

Figure 1:
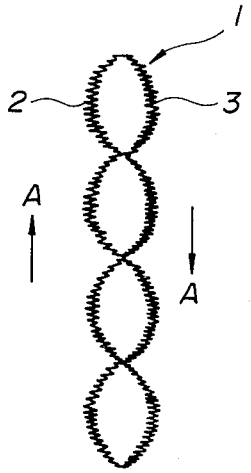
FIG. 1 is an explanatory view of an entire combination stitch to be sewn by a sewing machine.
Figure 3:
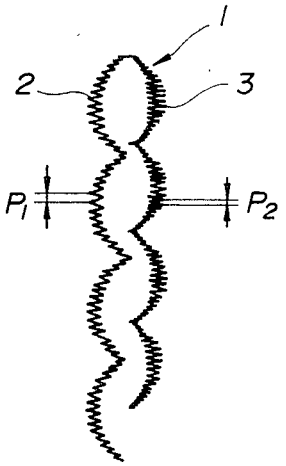
FIG. 3 Prior Art
FIG. 3 is an explanatory view of a combination stitch which is actually formed in accordance with the prior art.
Figure 6:
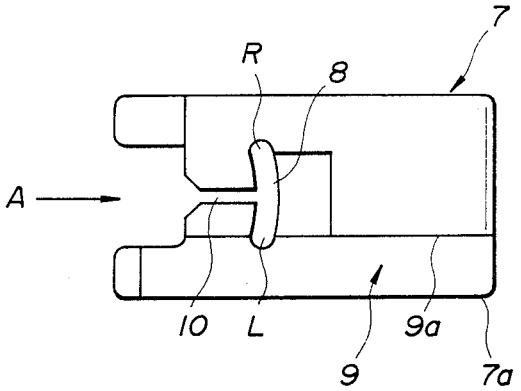
FIG. 6 is a bottom view of the presser foot taken in the direction of the arrow VI of FIG. 5.

Referring specifically to FIGS. 4–7, according to the invention a presser foot 5 comprises a presser foot holder 6 mounted on the lower end of a presser bar 8 and a presser foot sole 7 detachably connected to the lower end of the presser foot holder 6. The presser bar 8' is mounted on a machine housing (not shown) and vertically displaceable. The presser foot sole 7 is preferably made of a transparent material such as synthetic resin. The sole 7 is provided with a needle dropping hole 8 laterally elongated to pass therethrough a reciprocating and swinging needle 14 accompanied by a thread 15.

According to the invention, the presser foot sole 7 has a recess provided on the bottom **7*b* at one side 7*a* thereof. The recess 9 is defined by a face 9*b* positioned at a level higher than the bottom 7*b* with a vertical distance (h) and extending is parallel with the bottom 7*b*, and by a vertical wall 9*a* connecting the inner end of the face 9*b* to the bottom face 7*b* and extending in the feeding direction A' transversely of one of the needle dropping points (R,L) of the lateral swinging amplitude of the needle 14 within the laterally elongated dropping hole 8, so that the remaining portion 7*b* of the bottom of the sole 7 can nevertheless sufficiently press the area of the fabric 16 to be sewn by laterally swinging needle 14. Both needle dropping points (R,L) intersect the sole bottom 7**.

The numeral 11 denotes a pin extending horizontally between a pair of mounts 12 secured to the upper surface of the sole 7, whereby the sole 7 is removably attached to the holder 6. The numeral 10 denotes a groove for guiding the needle and lower thread to the underside of the sole 7 before initiating the stitching operation.

Figure 4:
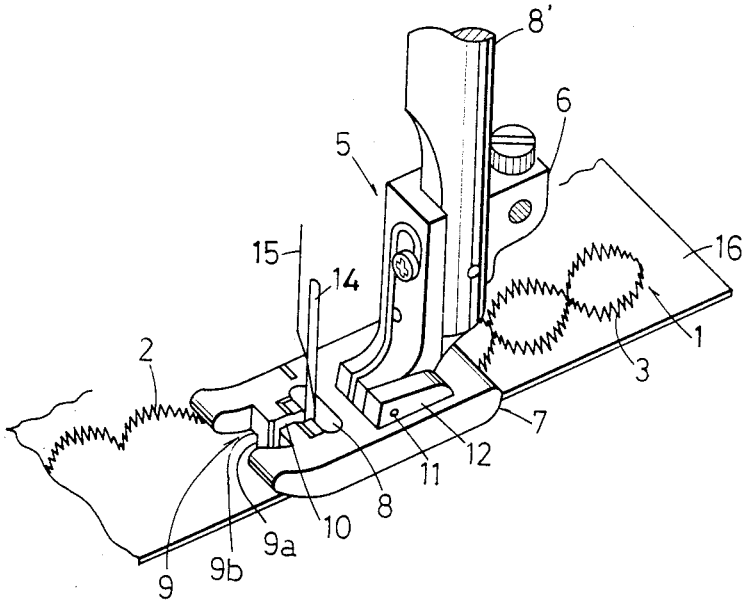
FIG. 4 is a perspective view of a presser foot of the invention when being used for sewing the combination stitch shown in FIG. 1.
Figure 5:
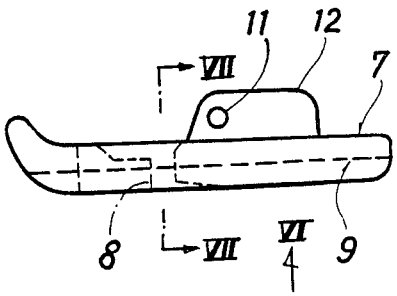
FIG. 5 is a side view of the presser foot shown in FIG. 4.
Figure 7:
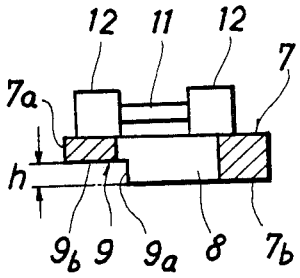
FIG. 7 is a sectional view taken in the direction of the arrows along the line VII—VII of FIG. 5.

The presser foot of the invention may be used in combination with the zigzag sewing machine to produce a combination stitch such as a pattern of stitches 1 as shown in FIG. 1. In the first place, a first series of stitches 2 are formed on the fabric 16 under the flat bottom face **7*a* of the sole 7 in the normal feeding direction. If the first series of stitches 2 have been completed, the frabric is turned 180-degree under the sole 7 (e.g. around the needle 14 as a pivot) to bring the lower end of the fabric to the top. Then, a second series of stitches 3 are formed in the same condition as the first series of stitches 2 were formed as shown in FIG. 4. In this case, the precedingly formed first series of stitches 2 are located under the recess 9 of the sole 7 and are substantially spaced from the bottom face 7*b*, and will not generate frictional resistance against the bottom face 7*b* of the sole 7 as the fabric is transported, which resistance may otherwise be additional to the frictional resistance caused by the fabric 16 against the bottom face 7***b* of the sole 7. Therefore, the second series of stitches 3 are formed in the same condition as that of the second series of stitches 2 with respect to the frictional resistance applied to the bottom face 7*b* of the sole 7. Thus, the feeding amount $P_2$ of the second series of stitches 3 will equal the feeding amount $P_1$ of the first series of stitches 2 and a symmetric design as shown in FIG. 1 can be produced without being deformed.

Moreover, according to a preferable embodiment, the sole 7 of a transparent material will make visible the first series of stitches 2 in relation to the second series of stitches 3 as the latter are being formed. This can improve sewing efficiency in forming a combination stitch.

Although the invention has been shown and described in terms of a preferable embodiment thereof, it should be understood that many changes and modifications will be obvious to one skilled in the art without departing from the true spirit and scope of the invention as defined in the appended claims.

We claim:

1. A presser foot to be used in combination with a zigzag sewing machine for producing a combination stitch, including a needle dropping hole (8) formed therein adapted to allow lateral swinging movement of a reciprocating needle between two needle dropping points, a recess (9) provided in a bottom work-facing surface (7*b*) and extending along one entire side thereof, said recess being defined by a face (9*b*) positioned higher than the remainder of the bottom surface (7*b*) of the presser foot with a predetermined vertical distance therebetween and by a side wall (9*a*) connecting the inner end of said face (9*b*) and the remainder of the bottom face (7*b*) and extending laterally of one of the needle dropping points of said laterally swinging needle within said needle dropping hole (8) wherein said work-facing surface includes both needle dropping points.

2. The presser foot according to claim 1 which is made of a transparent material.

* * * * *